US005123492A

United States Patent [19]

Lizanec, Jr.

[11] Patent Number: 5,123,492

[45] Date of Patent: Jun. 23, 1992

[54] METHOD AND APPARATUS FOR INSPECTING SUBSURFACE ENVIRONMENTS

[76] Inventor: Theodore J. Lizanec, Jr., 19257 N. 21st Dr., Phoenix, Ariz. 85027

[21] Appl. No.: 664,230

[22] Filed: Mar. 4, 1991

[51] Int. Cl.[5] ..... E21B 47/00

[52] U.S. Cl. ..... 175/49; 166/242; 166/250

[58] Field of Search ..... 175/45, 49; 166/250, 166/253, 254, 255, 242

[56] References Cited

U.S. PATENT DOCUMENTS

| | | | |
|---|---|---|---|
| 2,971,259 | 2/1961 | Hahnaw et al. | 33/1 |
| 3,958,632 | 5/1976 | Buchman et al. | 166/85 |
| 3,974,330 | 8/1976 | Askowith et al. | 178/6.8 |
| 4,391,337 | 7/1983 | Ford et al. | 166/299 X |
| 4,532,545 | 7/1985 | Hanson | 358/100 |
| 4,855,820 | 8/1989 | Barbour | 358/100 |
| 4,898,241 | 2/1990 | Wittrisch | 166/250 |
| 4,934,866 | 6/1990 | Gage | 405/54 |

*Primary Examiner*—William P. Neuder
*Attorney, Agent, or Firm*—Richard G. Harrer; Charles E. Cates

[57] ABSTRACT

Methods for visual inspection of subsurface environments by emplacing a substantially visually clear pipe or casing into the subsurface environment and thereafter introducing visual inspection, means, such as a video camera, into the pipe, whereby inspection of the subsurface environments may be accomplished directly through the wall of the pipe. The inspection may also be accomplished by emplacing an opaque pipe provided with spaced part visually clear windows into the subsurface, and thereafter introducing visual inspection means into the pipe to inspect subsurface environments through the windows of the pipe. The invention additionally includes improved piping or casing which is constructed of typical opaque materials such as steel, but which is provided with visually clear windows appropriately spaced throughout the casing.

15 Claims, 2 Drawing Sheets

METHOD AND APPARATUS FOR INSPECTING SUBSURFACE ENVIRONMENTS

FIELD OF THE INVENTION

The present invention relates to methods and apparatus for investigating and/or inspecting subsurface environments, and more particularly to methods for visual inspection of such subsurface environments, and even more particularly to methods which allow devices such as video cameras to be employed in conducting such investigations. The invention also includes improved apparatus for use in conducting such investigations and explorations.

BACKGROUND OF THE INVENTION

The reasons for investigating, exploring or inspecting the subsurface environment are almost endless in number. A borehole is an artificial excavation typically made to extract water, oil, gas and other materials from the earth. There of course is also the use of boreholes for exploration and inspection purposes. For example, boreholes are drilled in the earth to locate mineral or gas or oil deposits, to help locate the most accessible ground water reservoirs, geothermal supplies, and to check for subsurface integrity and stability for location of depositories for nuclear waste and other materials that require underground storage. Additionally, the demand for ground water resources has accelerated so rapidly in recent years that the demand is at a point where new sources of high quality water are increasingly difficult to find since so many of the most accessible reservoirs are already tapped and utilized. Thus utilization of a variety exploration techniques is essential in locating new aquifers of high quality water. Additionally, the measuring of fluid movement within the subsurface can be of great significance. Thus, the need to characterize subsurface conditions is of immense commercial and environmental importance.

It is of course possible, in large diameter boreholes, to physically lower a trained geologist into the hole with a light source to visually examine the stratification, fracturing and layering of various geological formations to the depth that the borehole penetrates. However, such a technique has severe limitations from both a practical and safety standpoint. A significant advance has been made by virtue of closed circuit television camera systems for visually examining the walls of a given borehole. Television cameras measuring as small as 1 ½ inches in diameter are capable of surveying deep into holes to provide sharp images of actual subsurface conditions. Such cameras are designed to meet the inspection needs of the ground water industry; gas, oil and mining industries; public works officials; environmentalists and others in pinpointing problems. Such cameras can assist in analyzing geologic strata in ground formations, study variations in soil coloration to ascertain chemical and mineral content, detect damage in underground petroleum storage tanks and piping, as well as to help provide visual proof of compliance with various governmental inspection requirements.

Although such television inspection systems are frequently used in boreholes to analyze and inspect geologic strata, ground formations and the like, soil conditions or borehole collapse because of cave-ins, either prevents use of such equipment entirely, or in some cases results in the equipment being trapped in a borehole with possible loss or damage to the equipment, or at the very least the expenditure of considerable effort in recovery.

Such photographic equipment has, of course, also been used to inspect the interior of well casings to locate corrosion, obstructions, incrustations and generally to determine the condition of such casings; also to verify the success of cleaning and repair procedures. However, because of the opaque nature of casing materials, it is not possible for such inspection systems to inspect any area other than the interior of the casing.

Accordingly it is a principal object of this invention to provide a method for inspecting subsurface environments through the use of a borehole or other artificial excavation whereby integrity of the borehole is maintained and photographic equipment or other inspection means can be employed to inspect such environments without danger of loss or damage.

It is a further object of this invention to provide a method for allowing for visual inspection of the exterior of previously emplaced casings, either on a temporary or permanent basis.

It is a still further object of this invention to provide a casing which allows for visual inspection of not only the interior of the casing but the environment surrounding the casing as well.

These and other objects and advantages of this invention will become more apparent in the following description and appended claims.

SUMMARY OF THE INVENTION

The present invention provides methods for visual inspection of subsurface environments by emplacing a substantially visually clear pipe or casing into the subsurface environment to allow inspection means, such as a video camera, to be lowered into the pipe, and to provide images of subsurface conditions. In its most basic form, the methods include providing a borehole or other artificial excavation into the subsurface, thereafter emplacing a substantially visually clear pipe into the borehole, either on a temporary or a permanent basis, and thereafter introducing a suitable inspection means such as photographic equipment into the pipe to inspect and record subsurface conditions at various levels. The use of visually clear pipe not only maintains the integrity of the borehole walls, but at the same time permits inspection of the area of the subsurface adjacent to the borehole directly through the pipe. The emplacement of the visually clear pipe can be accomplished by conventional well drilling methods that include: cable tool, direct rotary, reverse circulation rotary, casing driver, jet drilling, bucket auger, solid or hollow stem auger, percussion hammer or well points. The invention is operable to all the disciplines that investigate subsurface environments such as geotechnical engineering, hydrogeology, water resources and environmental engineering and mining.

In a number of geologic settings, the stability of borehole walls precludes the use of borehole geophysics or down hole camera surveys to characterize subsurface conditions. Thus, temporary emplacement of a visually clear pipe in the subsurface permits characterization of subsurface conditions without concern of borehole collapse onto a down hole camera or its appertinences.

Another application of this invention is in the emplacement of a well point of a predominantly visually clear construction into the subsurface to permit characterization of the subsurface environment through visual inspections using a down hole video camera. A shallow well/piezometer is often installed in unconsolidated soils by advancing a well point (a screening device equipped with a point on one end that is meant to be driven into the ground). A primary advantage of advancing a well point is relatively low cost per installation but a major disadvantage of advancing a well point, however, is not obtaining samplings of subsurface soils to perform characterization of conditions. Thus, this invention provides for the emplacement of a well point of predominantly visually clear construction to permit such characterization of subsurface conditions. This invention is also applicable to water well completion by the so-called material development method where the screen of the well is placed in direct contact with the aquifer materials with no filter pack being used. By emplacing a modified visually clear pipe into the subsurface to act as a well casing/screen, visual inspection of the borehole walls can be performed prior to, during, and at any time thereafter in well development, well development being the act of repairing damage to the formation caused by drilling procedures and increasing the porosity and permeability of the material surrounding the intake portion of the well.

This invention is also applicable to the completion of water wells by the method of filter packing. Water wells are often completed by this method which consists of placing sand or gravel that is smooth, uniform, clean, well rounded, and siliceous in the annulus of the well between the borehole and the well screen to prevent formation material from entering the screen. By emplacing a modified visually clear pipe into the subsurface to act as a well casing/screen, visual inspection of the filter pack can be performed prior to, during, and any time thereafter during well development.

Another application of this invention is in the visual inspection of the filter pack of a ground water production well. Large diameter ground water production wells installed in unconsolidated to semi-consolidated soils are generally completed with a filter pack. By this invention, a modified visually clear pipe is emplaced into the subsurface environment within the filter pack, that is, between the outer surface of the production well casing and the borehole annulus. This permits inspection of the filter pack and possibly even the wall of the borehole prior to, during and at any time thereafter during well development. Visual inspection of the well filter pack could allow for more economical rehabilitation of such wells.

This invention provides a method useful in measuring the movement of fluids within the subsurface environments. By such method, a modified visually clear pipe is emplaced in the subsurface and thereafter a video camera is lowered into the pipe and the transient movement of fluids may be viewed and recorded. The application includes monitoring of petroleum spills, releases of hydrophobic liquids such as halogenated hydrocarbons, and lechates from tailings, waste dumps and land fills. Such visual inspection can be performed in either the saturated or unsaturated zones.

This invention also includes improved piping or casing for use in conducting subsurface inspections. Piping that is installed in boreholes is generally referred to as "casing" which is manufactured in a wide variety of compositions, dimensions and designs. Such casing is typically made of steel, thermoplastics, fiberglass, concrete, or asbestos cement. All of these compositions except thermoplastics are inherently opaque. Thermoplastic casing is manufactured as an opaque product, generally in the colors of either white, grey, or black. Visually clear piping is currently available for purposes other than subsurface environment inspection as a reinforced acrylic thermoplastic and is commercially available in diameters of six to eight inches or less. Such piping is useful in this invention to depths of generally less than 400–500 feet and thus is suitable for many of the subsurface inspections according to the methods of this invention.

Where the methods of this invention are to be used in special conditions, for example, at greater depths or perhaps require the use of larger diameter casings, this invention also includes casing which is constructed of the typical opaque materials such as steel, fiberglass, concrete and the like but which is provided with visually clear "windows" appropriately spaced throughout the length of the casing so as to provide a means whereby subsurface inspection according to this invention may still be carried out. Such casing could have a diameter up to 36 inches or more and would be used at depths up to 1000 or more feet.

Moreover, there may be very special conditions where the subsurface inspections, although not requiring large diameter casings, make the use of the visually clear casing not totally satisfactory. Thus this invention also includes specially reinforced visually clear casing, that is visually clear casing which has been specially reinforced by the use of generally rod shaped reinforcing members of steel, brass or other rigid materials incorporated into the casing wall. Such reinforcing members can be molded into the visually clear casing wall and spaced about the periphery of the casing so that a sufficient visually clear area of the casing is available for inspection of the subsurface environment.

DESCRIPTION OF THE PREFERRED EMBODIMENTS

Figure 1:
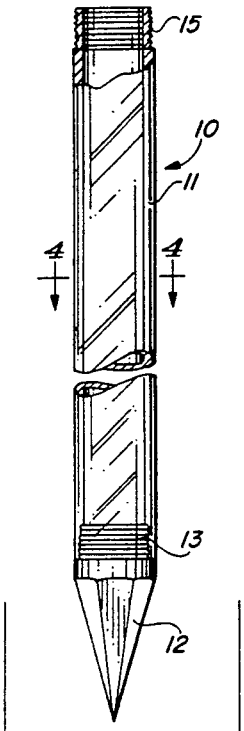
FIGS. 1–3 are partial perspective views of visually clear well points.
Figure 2:
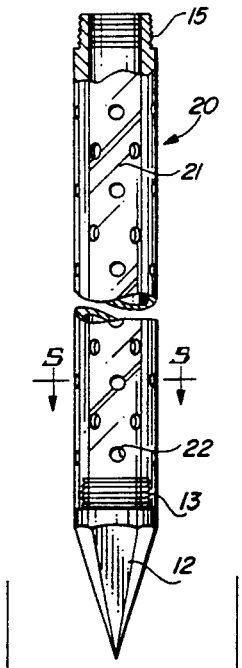
Figure 3:
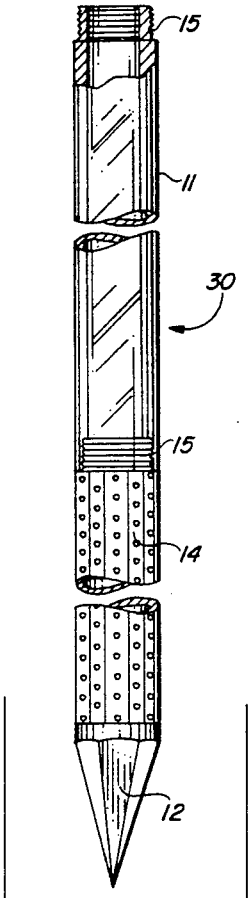
Figure 4:
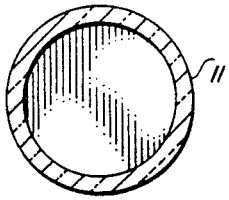
FIG. 4 is a sectional view taken on line 4—4 of FIG. 1.
Figure 5:
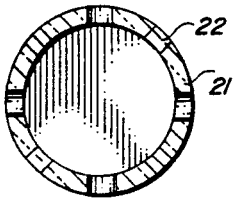
FIG. 5 is a sectional view taken on line 5—5 of FIG. 2.

FIGS. 1–3 inclusive show three different visually clear well points, shown generally at 10, 20 and 30 and which are useful in the methods of this invention. These well points include a heavy ductile iron hex shaped point 12 attached to various types of visually clear casings. As shown in FIG. 1, the well point 10 includes visually clear, rigid casing 11 which can be manufactured from a clear polyvinylchloride (PVC) material to which a heavy ductile iron hex shaped point 12 has been attached by means of threaded joint 13. The opposite end of casing 11 is provided with threads 15 so that additional lengths of visually clear casing may be attached. As shown in FIG. 2, the well point 20 again has a hex shaped point 12 but the visually clear casing 21 is provided with spaced apart perforations 22. As will be later explained in more detail, this perforated clear casing is useful in water well completion by tapping into water bearing aquifers. Additional lengths of visually clear casing may be attached to casing 21 by means of threaded connector 15. The well point 30 shown in FIG. 3 employs a perforated jacket 14 which can be of stainless steel or brass. Although not shown, the interior of jacket 14 is provided with a gauze made of stainless steel or brass and having a mesh size ranging from 50–100. Secured to jacket 14 is a length of visually clear casing 11, this length of casing also being provided with threads 15 for attachment of additional lengths of visually clear casing.

Figure 6:
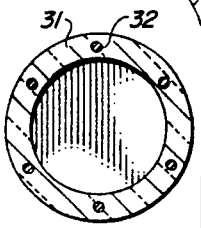
FIG. 6 is a sectional view of a visually clear pipe provided with reinforcing rods.

Since there may be very special conditions where the visually clear casing 11 is not strong enough to withstand certain conditions, as shown in section in FIG. 6, the visually clear casing 31 may be reinforced by the use of reinforcing members 32. Reinforcing members 32 are rod shaped and made of steel, brass or other rigid material, and are incorporated into the casing wall 31 and spaced about the periphery of the casing so that a sufficient visually clear area of the casing is available for inspection of the subsurface environment. Reinforcing members 32 extend the length of the casing.

Figure 7:
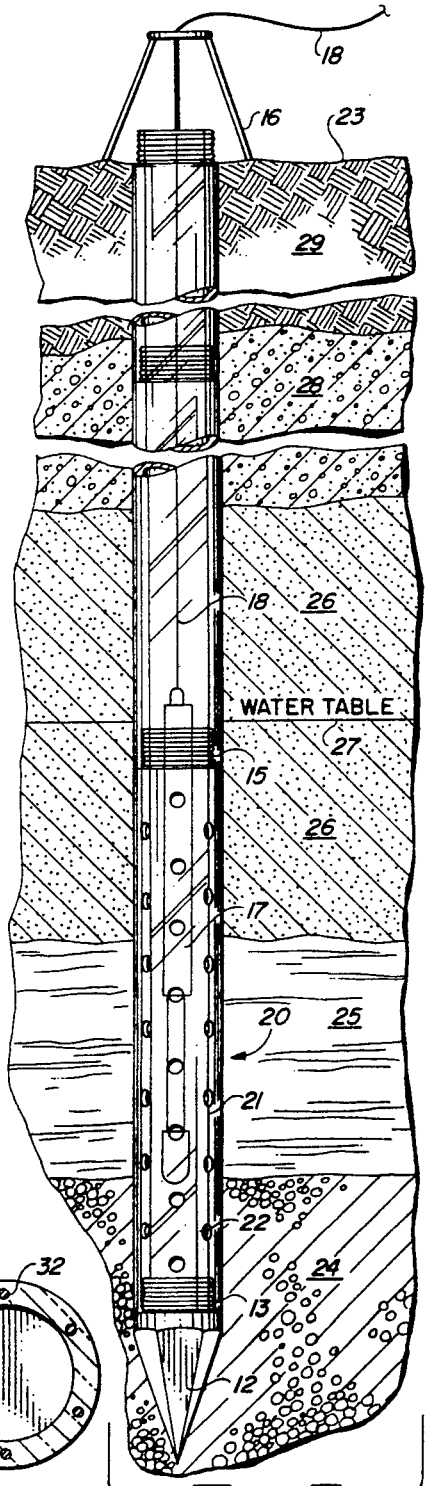
FIG. 7 is a vertical sectional view of a well provided with visually clear casing and a video camera located below the surface and in the well casing.
Figure 8:
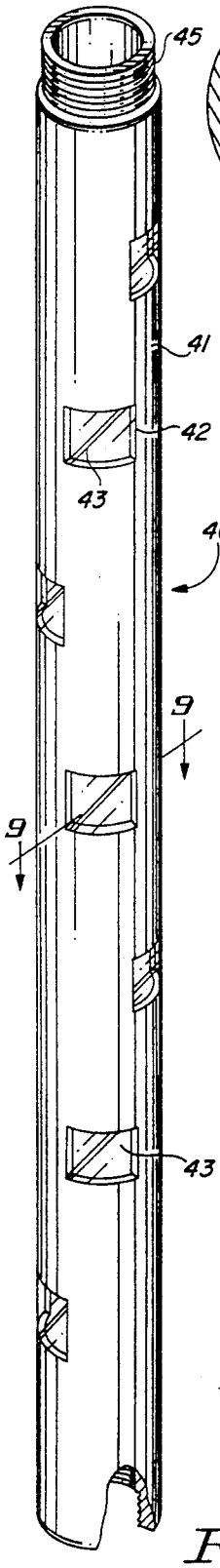
FIG. 8 is a partial perspective view of a length of casing provided with a series of visually clear windows.
Figure 9:
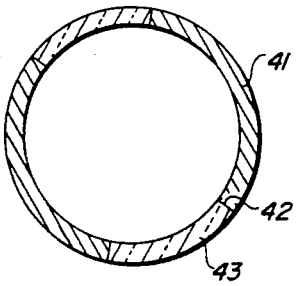
FIG. 9 is a sectional view taken on the line 9—9 of FIG. 8.
Figure 10:
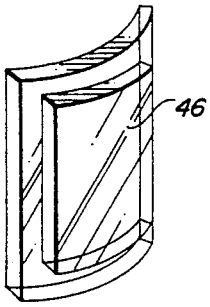
FIG. 10 is a perspective view of the visually clear window of the casing shown in FIG. 11.
Figure 11:
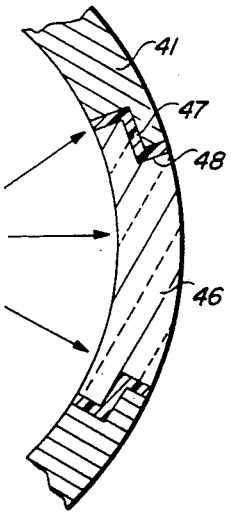
FIG. 11 is a sectional view taken through an opaque casing having a visually clear window.
Figure 12:
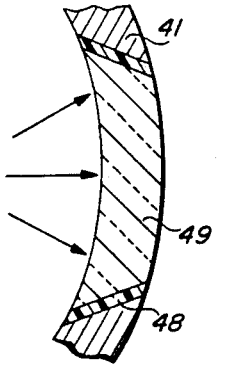
FIG. 12 is a part sectional view of a visually clear window in an opaque casing.

In FIG. 7 there is shown a well provided with a visually clear casing and a video camera positioned within the casing and below the surface of the ground 23. The borehole has been previously prepared by conventional well drilling methods as previously described. As shown, the subsurface environment is rather typical of that found in water bearing aquifers and includes the surface soils, basically topsoil 29, followed by a layer of sand and gravel 28, and a still deeper layer of sand 26, a layer of clay 25, and ultimately a layer of course gravel 24. The water table is shown at 27. Following drilling of a borehole a visually clear well point 20 such as shown in FIG. 2 is introduced into the borehole, the well point being provided with additional sections of visually clear pipe 11. Thereafter video camera 17 provided with cable 18 is lowered into the visually clear casing to a level below the water table 27. The video camera is supported on the surface 23 by tripod 16 and the cable 18 is led to appropriate video processing and display units which are not shown. In this embodiment the visually clear perforated section 20 of the well point is in direct contact with the water bearing subsurface area. By means of the video camera, the condition of both the interior and exterior of the well casing may be readily ascertained. Additionally, the condition and nature of the subsurface environment surrounding the casing may be readily inspected and evaluated which information can be very useful in determining the appropriate level for water recovery. Although the foregoing relates particularly to the use of visually clear casing in ground water recovery, it will be appreciated that the method is applicable to other disciplines that investigate subsurface environment such as geotechnical engineering, hydrogeology, water resources, and environmental engineering and mining.

Where the methods of this invention are to be used in special conditions, for example, at depths ranging up to 1000 or more feet or perhaps require the use of very large diameter casings, the invention also includes casings which are constructed of typical opaque material used in casing manufacture such as steel, fiberglass, concrete and the like but which are provided with visually clear "windows". FIGS. 8–12 inclusive illustrate such special casings. As shown in FIG. 8, a pipe or casing shown generally at 40 is of relatively large diameter, that is more than about eight inches in diameter, and includes casing wall 41 which is manufactured from an opaque material such as steel, fiberglass, concrete and the like. The casing wall has been cut to provide openings 42 to the interior of the casing which are appropriately spaced throughout the length of the casing. A visually clear material 43 such as PVC or "Lexan" is inserted into the opening 42 to form a visually clear window whereby subsurface inspections according to this invention may still be carried out. As shown in section in FIG. 9, the openings 42 to the interior of the casing are chamfered slightly and then the visually clear window 43 can be adhesively secured into the opening by means of a suitable adhesive. Where the pressure in the interior of the casing is relatively high, the window construction shown in FIGS. 10–12 may be employed. As shown in FIG. 11, the opening 47 in casing 41 has been cut in a "stair step" fashion and then window 46, shown in detail in FIG. 10, is inserted into the opening by means of a suitable adhesive 48. A further variation is shown in FIG. 12 where the opening to the casing 41 is cut at a greater angle and then the visually clear piece 49 again is adhesively secured within the opening by means of adhesive 48.

A still further application of this invention is in the area of formation stabilizers and filter pack in ground water production wells. Formation stabilizer is a term applied to the filling of the annular space between the borehole and well casing and screen in unstable ground formations to prevent sloughing. If the character of the aquifer indicates sand will be produced with the discharge water, then a selected, finer "filter pack" is customarily used. The filter pack performs the function of a formation stabilizer while filtering the formation particles. Installation of a properly designed filter pack can extend well life and reduces maintenance costs. Thus, large diameter ground water production wells installed in unconsolidated to semi-consolidated soils are generally completed with a gravel envelope or filter pack.

It is generally accepted that a gravel envelope well is not required if 90% of the aquifer is coarser than 0.010 in. and the material has a uniformity greater than 2. However, experience has shown that some types of aquifers nearly always require a filter pack, such as beach sand deposits, some river alluvia and friable sandstone.

The need for and type of filter pack has typically been based on the reliability and accuracy of formation samples collected during drilling. However, cutting samples may not always be truly representative of the formation, regardless of the drilling method or the care exercised in obtaining the samples. (See *Handbook of Ground Water Development* by Roscoe Moss Company, copyright 1990, pages 253–258 for further discussion of this subject).

Employing this invention, a modified visually clear pipe can be emplaced into the subsurface environment prior to the actual drilling of the well to assist the engineers in evaluating the formation not only for the presence of a suitable aquifer but provide information as to the need for a formation stabilizer and the particular type if so required. Moreover, even after the production well casing has been installed in the borehole, a visually clear pipe can be emplaced between the well casing and borehole annulus to assist in determining the need for some type of formation stabilizer. Moreover, assuming the need for a formation stabilizer or filter pack, this invention may be also employed by emplacing a modified visually clear pipe into the subsurface within the filter pack which permits periodic inspection of the filter pack. If the visually clear pipe is emplaced immediately adjacent the well casing, inspection of both the condition of the exterior of the well casing and filter pack may be accomplished simultaneously. Further, the visually clear pipe may be emplaced in the filter pack immediately adjacent to the borehole annulus which allows simultaneous inspection of both the ground formation and the filter pack.

Figure 13:
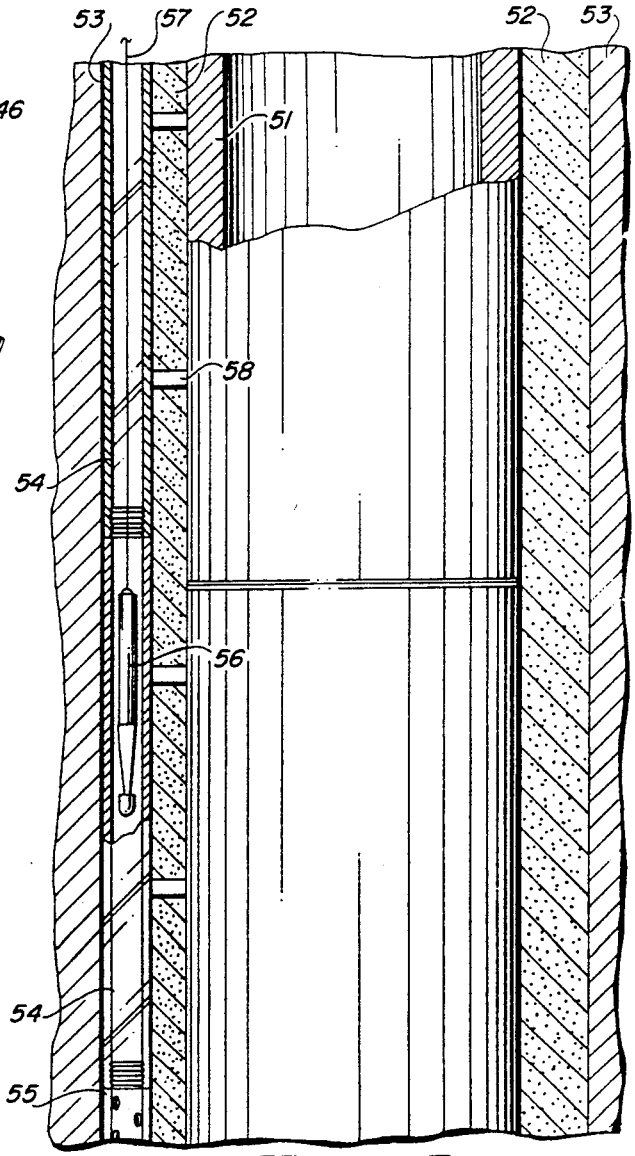
FIG. 13 is a vertical sectional view of a visually clear casing installed within the filter pack of a ground water production well.

In FIG. 13 there is shown a partial view of a large diameter ground water production well employing a conventional opaque steel casing 51. Between the outer surface of the production well casing 51 and the borehole annulus 53 is filter pack 52 consisting primarily of sand and/or gravel that is smooth and uniform. Emplaced within the filter pack 52 and adjacent to the borehole annulus are sections of visually clear pipe 54. Spacers 58 are provided at various levels to position the visually clear pipe 54 against the borehole annulus 53 prior to introducing the filter pack material. As shown, several sections of the pipe are joined together by means of appropriate threaded connections. The lower end of the visually clear pipe is provided with a visually clear perforated casing 55. Video camera 56 is shown suspended within the visually clear casing by means of cable 57 which leads to appropriate processing and display units, not shown. The installation of the visually clear pipe and appropriate inspection means permits not only the inspection of the filter pack but inspection of the ground formation as well. Such an installation may also be valuable in inspection of the well casing since any significant leakage of water from the casing would necessarily be picked up by the video camera.

What is claimed is:

1. A method for visually inspecting subsurface environments at varying levels comprising emplacing a substantially visually clear pipe into said subsurface environment and thereafter introducing visual inspection means into said pipe whereby inspection of said subsurface environments may be accomplished directly through the wall of said pipe.

2. The method of claim 1 wherein said pipe is emplaced by advancing a well point of substantially clear construction.

3. The method of claim 1 wherein an excavation is made into said subsurface environment prior to emplacing said pipe.

4. The method of claim 2 wherein said inspection means include photographic means.

5. The method of claim 3 wherein said inspection means include photographic means.

6. The method of claim 5 wherein said photographic means includes a closed circuit television camera.

7. The method of claim 6 wherein said excavation is a borehole and wherein said pipe serves to maintain the integrity of said borehole and to allow inspection by said television camera through the wall of said pipe.

8. A method of completing water walls comprising providing a borehole into the subsurface environment to a water bearing subsurface area, emplacing into said borehole a well point attached to a substantially visually clear casing into said water bearing area, whereby water may be recovered from said water bearing area and inspection means may be lowered into said casing to inspect the subsurface environment surrounding said casing and condition of said casing.

9. A method for visually inspecting the filter pack in a ground water production well comprising emplacing a substantially visually clear pipe within the filter pack surrounding the casing of well and immediately adjacent to said well casing, and thereafter introducing inspection means into said substantially clear pipe whereby inspection of said filter pack and well casing may be accomplished.

10. The method of claim 9 wherein said substantially clear pipe is emplaced within said filter pack and immediately adjacent to the annulus of the borehole of said well whereby inspection of said filter pack and borehole annulus may be accomplished.

11. A length of pipe useful as a casing for ground water wells and for inspection of subsurface environments comprising a length of pipe the walls of which are manufactured from an opaque material and wherein spaced apart, visually clear windows are provided throughout the length of said pipe whereby inspection means can be inserted into the interior of said pipe to inspect areas surrounding the exterior of said pipe.

12. The pipe of claim 11 wherein said opaque walls are steel.

13. The pipe of claim 12 wherein said visually clear windows are formed of PVC.

14. A method for visually inspecting subsurface environments at varying levels comprising emplacing an opaque pipe provided with spaced apart visually clear windows into said subsurface environments and thereafter introducing visual inspection means into said pipe whereby inspection of said subsurface environments may be accomplished directly through the wall of said pipe.

15. The method of claim 14 wherein said opaque pipe is made from steel and said visually clear windows are formed of PVC.

* * * * *